US007540655B2

(12) United States Patent
Speichinger

(10) Patent No.: US 7,540,655 B2
(45) Date of Patent: Jun. 2, 2009

(54) AUTOMATIC SETTING DEVICE

(75) Inventor: Ferdinand Speichinger, Neuhausen (CH)

(73) Assignee: Richemont International S.A., Villars-sur-Glane (CH)

( * ) Notice: Subject to any disclaimer, the term of this patent is extended or adjusted under 35 U.S.C. 154(b) by 663 days.

(21) Appl. No.: 11/037,165

(22) Filed: Jan. 19, 2005

(65) Prior Publication Data

US 2005/0162985 A1 Jul. 28, 2005

(30) Foreign Application Priority Data

Jan. 23, 2004 (CH) ..... 0090/04

(51) Int. Cl.
*G04B 27/02* (2006.01)
*G04B 29/00* (2006.01)
*G04B 39/00* (2006.01)

(52) U.S. Cl. ..... 368/190; 368/295; 368/319

(58) Field of Classification Search ..... 368/319–321, 368/306, 308, 206, 190, 295
See application file for complete search history.

(56) References Cited

U.S. PATENT DOCUMENTS 3,376,701 A * 4/1968 Denley et al. ..... 368/289
3,485,036 A * 12/1969 Feurer ..... 368/289
3,621,649 A * 11/1971 Vulcan et al. ..... 368/290
3,863,438 A * 2/1975 Soguel ..... 368/289
5,383,166 A * 1/1995 Gallay ..... 368/288
6,010,241 A * 1/2000 Bulgari ..... 368/190
6,200,020 B1 * 3/2001 Rieben ..... 368/290
6,896,403 B1 * 5/2005 Grau ..... 368/190
2007/0025190 A1 * 2/2007 Cretin ..... 368/319

FOREIGN PATENT DOCUMENTS

CH 01791/03 * 10/2003

* cited by examiner

*Primary Examiner*—Vit W Miska
(74) *Attorney, Agent, or Firm*—Young & Thompson

(57) ABSTRACT

A setting device (1) includes an outer crown body (11), an inner crown body (12) firmly connected to this, a coupling (13,14) mounted at the inner crown body, as well as a crown sleeve (15) at least partly enveloping the inner crown body (12) and the coupling (13,14), inside of which the inner crown body (12) is mounted in both axially adjustable and rotatable manner. The setting device (1) further includes an elastic element (16) exerting on at least one of the crown bodies (11,12) a force pre-tensioning it in its axial direction, the force of pretension of the elastic element (16) being determined as a function of the effective front surface (A) of the outer crown body (11), in order to allow for an automatic, axial change-over of position of the setting device as a function of the applied external pressure.

6 Claims, 2 Drawing Sheets

1
2
3
11
11a
12
13
14
15
15a
16
17
17a
18
19
21
22
23
31
32
33
$E_o$
$F_o$
$D_o$
$E_1$
$D_1$
$E_2$
$F_1$
$D_2$
F
A

AUTOMATIC SETTING DEVICE

The present invention concerns a setting device for a watch or clock and especially a setting device capable of being placed in a state of increased sealing and/or a deactivated state.

Such setting units, in particular also in the form of rotatably arranged crowns, exist in a multiplicity of embodiments. Often such crowns have two or several axial positions, at which different functions may be effectuated. The change-over is made manually by the user of the associated clock. For some applications, for example when using the clock during diving, where safety-relevant aspects play a role, this may be undesired or even unfavourable. In this context it is also to be mentioned that the different positions of such a setting unit mostly comprise different degrees of water tightness. Again, it is left to the user to bring the crown into the intended position with the best tightness before he undertakes for instance a dive, which for example takes place mostly by screwing the crown.

SUMMARY OF THE INVENTION

The goal of the present invention is therefore to avoid the aforementioned disadvantages and to provide for a setting unit which automatically effectuates the aforementioned procedures.

The subject matter of the present invention relates to a device as set out in the appended claims.

In particular, a setting device according to the invention comprises an elastic element, the force of pretension of which depends on the size of the front surface of the outer crown body of the device.

These characteristics allow to obtain a number of advantages. In particular, a setting device according to the present invention is able to be switched automatically from one axial position into another as a function of the applied external pressure, which provokes for example an automatic decoupling or coupling in order to render a function impossible or possible. Also, the setting device can switch automatically as a function of the applied external pressure into its best sealing position which is particularly advantageous in diving watches. These characteristics are realized in an easy manner according to the present invention.

Further characteristics and advantages result from the dependent claims as well as from the description illustrating in the following by means of the enclosed figures the invention in detail.

The enclosed figures represent by way of example an embodiment of a setting device according to the invention.

BRIEF DESCRIPTION OF THE DRAWINGS

The FIG. 1 represents a cross section of a setting device according to the present invention built into a watch case, the device being in its normal position.

The FIG. 2 is a cross section analogous to FIG. 1, in which the setting device is slightly axially shifted due to a rotation against the predetermined sense of rotation, in order to allow for unsnapping of the coupling.

Figures 1, 2, 3:
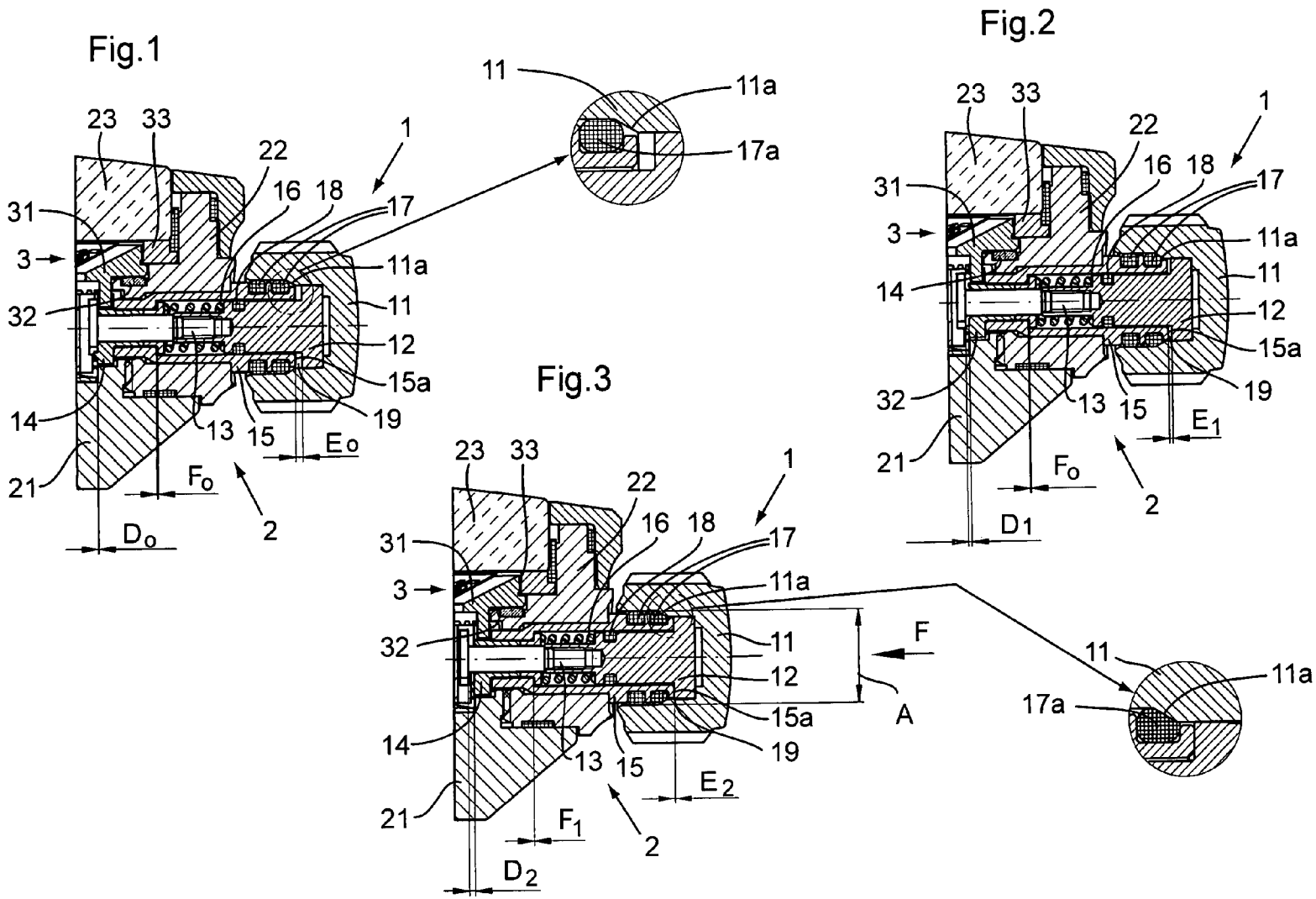

The FIG. 3 is again a cross section analogous to FIG. 1, in which the setting device is axially shifted due to the effect of the applied external pressure, in order to allow for a decoupling.

Figure 4:
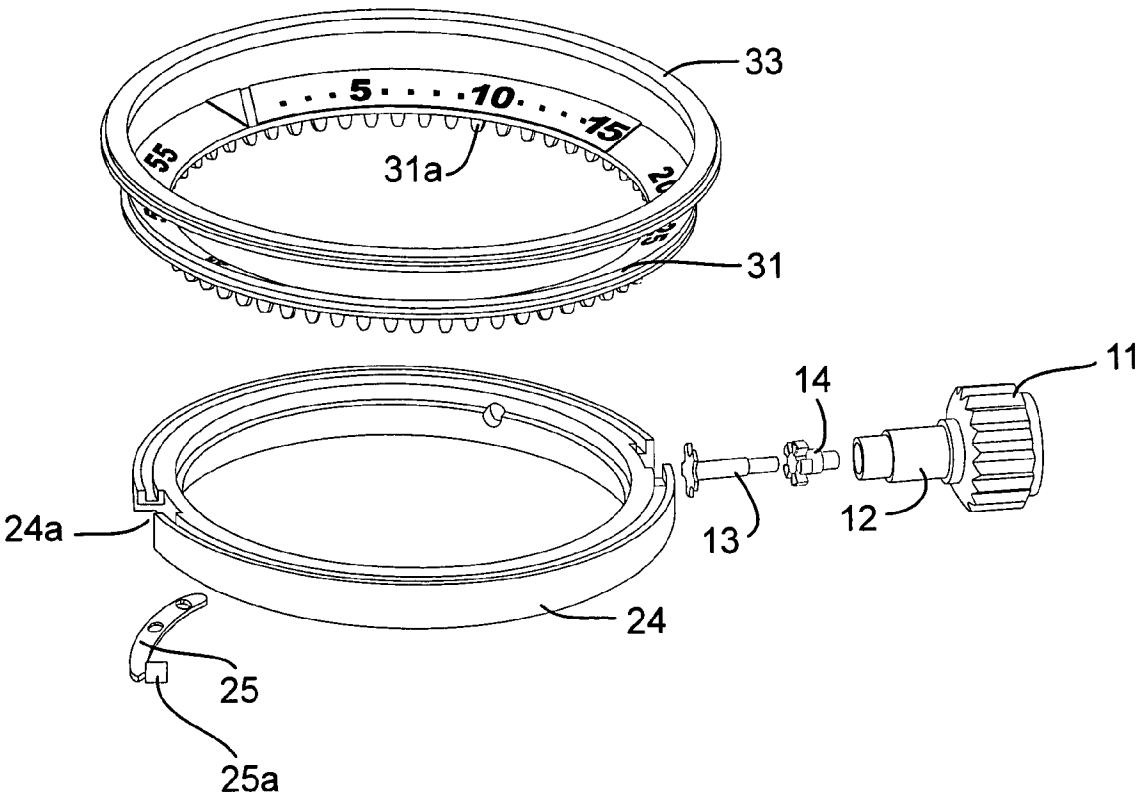

The FIG. 4 is an explosion representation of the most important parts of a setting device used for the controlling of a bezel including the parts belonging to the bezel.

Figure 5:
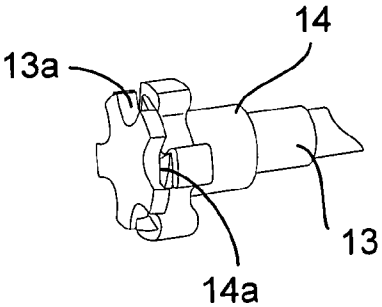

The FIG. 5 is a perspective representation of an example of a coupling usable in this context.

The invention will be described now in detail in the following with reference to the figures.

As is evident from FIG. 1, a setting device 1 according to the present invention comprises a crown body 11, 12. This can be manufactured from one piece or be built up of several, firmly connected individual parts, and comprises an outer crown body 12, which has essentially a pot-like shape, and an outer crown body 12. The latter is essentially cylindrically shaped and comprises a smaller outer diameter than the inner diameter of the pot shaped part of the outer crown body 12, in which it is fastened. Thus, the crown body comprises a ring shaped cavity 19 between its two parts 11, 12.

Furthermore, a coupling 13, 14, which can have different arrangement depending upon the intended application, is arranged in axial prolongation of the inner crown body 12 on this latter.

A crown sleeve 15 at least partly envelopes the inner crown body 12 and the coupling 13, 14, whereby these parts are stored rotatably in the crown sleeve. The crown sleeve 15 is placed as usual at a suitable place at the edge of the housing 2 of a clock, the outwardly pointing end of the crown sleeve 15 having essentially the shape of a hollow cylinder protruding into the circular cavity 19 between outer-11 and inner crown body 12.

Moreover, the setting device 1 has an elastic element 16, which attacks at at least one of the crown bodies 11, 12 for pre-tensioning it in its axial direction. Therefore, the crown body 11, 12 as well as parts of the coupling 13, 14 is mounted within the crown sleeve 15 both in an axially adjustable and rotating manner.

In particular, the force of pretension of the elastic element 16, which to overcome is necessary for an axial shift respectively a change-over in position of the setting device thus defined, is determined as a function of the effective front surface A of the outer crown body 11. This force F may be determined, at a given external pressure p, at which the change-over is to take place automatically, an effective front surface A, against which this pressure effectively applies (see FIG. 3), as well as an efficiency factor n, which is mainly due to the friction of the crown bodies 11, 12 on the crown sleeve 15 as well as on packing rings 17, 18 which will be addressed below, by the formula $F=p\times A\times n$.

Such an arrangement of a setting device allows to ensure an automatic, axial change-over in position of the setting device as a function of the applied external pressure.

As represented in the enclosed figures, the elastic element can in particular be realized as a spiral spring 16, which is arranged for example between the crown sleeve 15 and the inner crown body 12, enveloping a part of the coupling 13, 14. However, such a spring 16 could be arranged also between the crown sleeve 15 and the outer crown body 11. It is only of importance that a pre-tensioning of the crown body 11, 12 in axial direction is produced relative to the crown sleeve 15 fixed at the clock case 2.

This force of pretension preferably works, as represented in FIG. 1, in the direction pointing outwardly as seen from the housing, in order to thus define a normal position of the setting device at normal ambient pressure. At a given, higher external pressure the crown 11, 12 of the setting device automatically moves into an axially inwardly shifted position, like this is represented in FIG. 3. In principle, also a reverse constellation is conceivable, in which a force of pretension directed inwardly is applied, which causes an automatic shift of the crown 11, 12 towards the outward at low external pressure, the selected constellation being dependent on the desired application as this will be discussed at a later place.

By this automatic, axial shift respectively position change-over it is possible to provide for a self-sealing setting device.

For this purpose, at least one packing ring 17, 18 is arranged between the end of the crown sleeve 15 pointing outwardly, which penetrates into the circular cavity 19 between the inner-12 and outer crown bodies 11, and at least one of the crown bodies 11, 12. A chamfer 11*a* projecting into this cavity 19 is arranged in such a manner that it does not touch the associated packing ring 17*a* or only touch it slightly in the normal position of the setting device 1, while an automatic axial shift of the crown 11, 12 onto the contact surface 15*a* of the crown sleeve 15 produces a compression of this packing ring 17*a* and thus an automatic increase of the tightness of the setting device 1. This is of use in particular with diving watches, insofar as a setting device of the embodiment presented here starting from a predetermined depth due to the higher external pressure, i.e. at overpressure relative to the housing system, automatically performs a change-over in position and thus at the same time increases the tightness of the watch.

In particular, the packing ring(s) 17 can be arranged at the external side of the outwardly pointing end of the crown sleeve 15 and the chamfer 11*a* co-operating with these at the internal side of the outer crown body 11. This is the case in the present embodiment represented as an exemplary case in the figures, a further packing ring 18 being arranged here between the inner crown body 12 and the crown sleeve 15.

This arrangement could also be done differently, for example by arranging the packing rings 17 at the internal side of the outer crown body 11 and the chamfer 11*a* at the external side of the crown sleeve 15, or by putting one of these arrangements between the inner crown body 12 and the crown sleeve 15 while having a further packing ring 18 for instance at the outer crown body 11.

The automatic, axial shift by overcoming the force of pre-tension of the spring at a predetermined external pressure within the setting device according to the invention may also be used in a favourable manner in connection with the coupling 13, 14.

The coupling 13, 14 may for instance be arranged in such a manner that it is decoupled and coupled by an axial movement of the crown body 11, 12. Thus an automatic decoupling or coupling takes place at a (pre-)determined external pressure by the automatic, axial position change-over of the setting device, depending upon the concrete arrangement of the coupling.

The coupling shown in the figures has a so-called driving screw 13 which is arranged in a force coupled manner to the inner crown body 12, for instance screwed to it, with teeth 13*a* at its end oriented into the inside of the housing. It further comprises a gear wheel 14 mounted in a rotatable manner between the driving screw 13 and the crown sleeve 15, which has a Breguet side toothing 14*a* (also called Breguet toothing or saw toothing) oriented towards the teeth 13*a* of the driving screw 13. Therefore, the teeth. 13*a* of the driving screw 13 apply against the Breguet side toothing 14*a* of the gear wheel 14 in the normal position of the setting device, in which, according to FIG. 1, the spring 16 presses the crown 11, 12 outwardly, such that the coupling 13, 14 is coupled and a rotation of the outer crown body 11 causes a rotation of the gear wheel 14. The latter can propel, as will be discussed further below in the detail, a further element for exerting a certain function, depending upon the application. At (pre-) determined external pressure, however, as represented in FIG. 3, the crown 11, 12 and thus the driving screw 13 are shifted automatically axially inwardly, such that its teeth 13*a* no more apply against the Breguet side toothing 14*a* and thus the coupling is automatically decoupled. This is particularly of advantage within diving watches, to the extent that this does not only provoke an automatic increase of the tightness of the watch, but also an automatic increase of the safety with the help of this automatic decoupling by inactivating a function relevant for instance for the security of the diver.

The arrangement of the coupling described above allows that a force transmission from the outer crown body 11 to the gear wheel 14 takes place only when rotating into a given sense of rotation, while rotating in the opposite direction entails an unsnapping of the coupling. This is particularly visible in the perspective representation of the FIG. 5, where one recognizes that a small axial shift of the driving screw 13 occurs via the inclined surfaces of the Breguet side toothing 14*a* of the gear wheel 14 when rotating the outer crown body 11 in opposite direction, such that the gear wheel 14 is not propelled in this case. This unsnapping by a small axial shift inwardly is shown in the cross section of the FIG. 2, this position being a non-stationary, intermediate position between the normal position (see FIG. 1) and the second position (see FIG. 3) of the setting device 1 caused by increased external pressure.

Further embodiments of a coupling, which could be used in a setting device according to the invention, are conceivable and well-known. The coupling may for instance be realized by cooperating, polygonal surfaces instead of a side toothing; further possibilities are known in the state of the art. The coupling may also be arranged in such a way that automatic coupling takes place instead of automatic decoupling as in the present example, to which effect an arrangement of the side toothing 14*a* and of the teeth 13*a* of the driving screw 13 at the end of the gear wheel 14 pointing outwardly would be sufficient in the stated example.

In order to finally address one of many possible applications of such a setting device, reference shall be made to FIG. 4. Here, the setting device is used for controlling a toothed, internal rotating bezel 31. A movement ring 24, which is inserted into a watch case 2 having a lower housing part 21 (back cover) and an upper housing part 22 (FIG. 1), serves as seating for the bezel 31. The centring of this latter takes place by means of a supporting ring 33, which is placed under a watch glass 23, while the support of the bezel 31 in the housing 2 is realized by means of endstones 32, for example made of artificially manufactured ruby. The angular positioning of the bezel 31 is done by a snap spring 25 mounted in a recess 24*a* of the movement ring 24, a snap disk 25*a*, for instance made of artificially manufactured ruby, engaging the toothing 31*a* of the bezel 31 for its locking. By a special shaping of the snap spring 25 it can be achieved that the bezel 31 may only be advanced into one sense of rotation. The internal bezel mechanism 3 is now controlled by the setting device 1, insofar as a rotation of the outer crown body 11 (in the intended sense of rotation) in the normal position of the device (see FIG. 1) causes a rotation of the gear wheel 14, which engages the toothing 31*a* of the bezel 31 and thus rotates this latter. A rotation of the outer crown body 11 in the opposite direction causes an unsnapping of the coupling 13, 14 due to the blocking of the bezel 31 in this sense of rotation by the snap spring 25, as represented in FIG. 2, such that the bezel 31 is not moved in this case. Finally, if a (pre-)determined, increased external pressure applies at the outer crown body 11, an automatic, axial position change-over of the crown occurs (see FIG. 3), which provokes an increased tightness and an automatic decoupling, such that the bezel 31 is not adjusted in case of (inadvertent) rotation of the outer crown body 11.

Such a setting device is therefore particularly of use within diving watches, since in this case an inadvertent adjustment of the bezel would be of importance for the safety of the diver and must be avoided.

Further applications like the use for adjustment of a wake up time within an alarm clock, of a time zone within a world time watch, etc., are conceivable, such that the invention is not limited to the example explicitly represented here.

The invention claimed is:

1. A setting device for a watch, comprising:

a crown body having an inner portion;

a coupling operable to couple, in at least one of an axially adjustable manner and with a rotating manner, the inner portion of the crown body to a mechanism within the watch;

a crown sleeve fixed to a case of the watch and at least partly enveloping the inner portion of the crown body and the coupling, the crown body being mounted within the crown sleeve in both an axially adjustable manner and a rotatable manner; and an elastic element, positioned against the crown body so as to bias the crown body in an axial direction with respect to the crown sleeve, wherein the elastic element is operable to automatically effect a change in the axial position of the crown body with respect to the crown sleeve in response to a change in an external pressure applied to an outer portion of the crown body, such that an inner portion of the crown body may be coupled and decoupled to the mechanism solely in response to said external pressure, and wherein the coupling is operable i) to couple a rotation of the crown body to the mechanism when the crown body is rotated in a first direction, and ii) not to couple the rotation of the crown body to the mechanism when the crown body is rotated in a second direction opposite said first direction.

2. A setting device for a watch, comprising:

a crown body having an inner portion;

a coupling operable to couple, in at least one of an axially adjustable manner and with a rotating manner, the inner portion of the crown body to a mechanism within the watch;

a crown sleeve fixed to a case of the watch and at least partly enveloping the inner portion of the crown body and the coupling, the crown body being mounted within the crown sleeve in both an axially adjustable manner and a rotatable manner; and an elastic element, positioned against the crown body so as to bias the crown body in an axial direction with respect to the crown sleeve, wherein the elastic element is operable to automatically effect a change in the axial position of the crown body with respect to the crown sleeve in response to a change in an external pressure applied to an outer portion of the crown body, such that an inner portion of the crown body may be coupled and decoupled to the mechanism solely in response to said external pressure, and wherein the coupling comprises i) a driving screw, having a set of teeth and mounted on the inner crown portion, and ii) a coupling gear wheel mounted in a rotatable manner between the driving screw and the crown sleeve, the coupling gearwheel having a saw toothing oriented towards the teeth of the driving screw and configured to engage with the teeth of the driving screw when the crown body is coupled to the mechanism.

3. A setting device for controlling a rotating bezel mechanism of a watch, the setting device comprising:

a crown body having an inner portion;

a coupling operable to couple, in a rotating manner, the inner portion of the crown body to the bezel mechanism;

a crown sleeve, fixed to a case of the watch and at least partly enveloping the inner portion of the crown body and the coupling, the crown body mounted within the crown sleeve in both an axially adjustable manner and a rotatable manner; and an elastic element, positioned against the crown body so as to bias the crown body in an axial direction with respect to the crown sleeve, wherein the elastic element is operable to effect a change in the axial position of the crown body with respect to the crown sleeve in response to a change in an external pressure applied to an outer portion of the crown body.

4. The setting device according to claim 3, wherein a gear wheel of the coupling engages a toothed rim of the bezel in order to drive the bezel in rotation.

5. The setting device according to claim 3, wherein the coupling is operable i) to couple a rotation of the crown body to the mechanism when the crown body is rotated in a first direction, and ii) not to couple the rotation of the crown body to the mechanism when the crown body is rotated in a second direction opposite the first direction.

6. The setting device according to claim 3, wherein the coupling comprises i) a driving screw, having a set of teeth and mounted on the inner crown portion, and ii) a coupling gear wheel mounted in a rotatable manner between the driving screw and the crown sleeve, the coupling gear wheel having a saw toothing oriented towards the teeth of the driving screw and configured to engage with the teeth of the driving screw when the crown body is coupled to the mechanism.

* * * * *